US006094004A

United States Patent [19]

Kim et al.

[11] Patent Number: 6,094,004

[45] Date of Patent: Jul. 25, 2000

[54] FOCUSING ELECTRODE IN ELECTRON GUN FOR COLOR CATHODE RAY TUBE

[75] Inventors: Youn Jin Kim; Hyun Cheol Kim; Sung Gi An; Sung Ho Cho, all of Kyungsangbuk-do, Rep. of Korea

[73] Assignee: LG Electronics Inc., Seoul, Rep. of Korea

[21] Appl. No.: 09/052,946

[22] Filed: Apr. 1, 1998

[30] Foreign Application Priority Data

Apr. 1, 1997 [KR] Rep. of Korea ..... 97-12017

[51] Int. Cl.[7] ..... H01J 29/51

[52] U.S. Cl. ..... 313/414; 313/428; 313/432; 313/439

[58] Field of Search ..... 313/411, 413, 313/414, 409, 417, 412, 428, 432, 439; 315/15, 382, 368.15

[56] References Cited

U.S. PATENT DOCUMENTS

| | | | |
|---|---|---|---|
| 4,119,884 | 10/1978 | Blumenberg et al. | 313/414 |
| 4,599,534 | 7/1986 | Shirai et al. | 313/414 |
| 4,772,827 | 9/1988 | Osakabe | 313/414 |
| 4,990,822 | 2/1991 | Guzowski et al. | 313/414 |
| 5,027,043 | 6/1991 | Chen et al. | 313/412 |
| 5,126,625 | 6/1992 | Cho | 313/413 |
| 5,170,101 | 12/1992 | Gorski et al. | 313/412 |
| 5,532,547 | 7/1996 | Park et al. | 313/412 |

*Primary Examiner*—Ashok Patel

[57] ABSTRACT

Focusing electrode in an electron gun for a color cathode ray tube, is disclosed, which can reduce a man-power and a number of components in a fabrication of the electron gun and can prevent a center electron beam from being elongated horizontally depending on a fitted depth of an inner guide electrode, the focusing electrode including a first focusing electrode adapted to be applied of a low static voltage and having a face with three vertically elongated electron beam pass-through holes of a key hole type and an inner guide electrode with three electron beam passthrough holes disposed at an inner side of the face, and a second focusing electrode adapted to be applied of a high dynamic voltage and having correcting electrodes unitary with a face of the second focusing electrode opposite to the first focusing electrode formed in a cathode direction at upper and lower sides of each of the three electron beam pass-through holes, whereby facilitating changes of center and side powers of the dynamic quadrupole lenses formed between the electron beam pass-through holes/the inner guide electrode in the first focusing electrode and the correcting electrodes on application of the dynamic voltage to the second focusing electrode by changing lengths between the center correcting electrode and the side correcting electrodes according to a fitted depth of the inner guide electrode in the second focusing electrode.

21 Claims, 4 Drawing Sheets

FOCUSING ELECTRODE IN ELECTRON GUN FOR COLOR CATHODE RAY TUBE

BACKGROUND OF THE INVENTION

1. Field of the Invention

The present invention relates to an electron gun for a color TV, or a high definition industrial picture tube, and more particularly, to a focusing electrode in an electron gun for a color cathode ray tube which can reduce man-power and number of components in a fabrication of the electron gun and can prevent a center electron beam from being elongated horizontally depending on a fitted depth of an inner guide electrode.

2. Discussion of the Related Art

The electron gun in a color cathode ray tube is a device for forming a pixel by focusing three electron beams emitted from cathodes onto a fluorescent screen of red, green and blue fluorescent materials inside of a cathode ray tube screen.

FIG. 1A illustrates a cross section of an exemplary background art in-line type electron gun, disclosed in Japanese Laid Open Patent Application(A) No. S61-250933 dated Nov. 8, 1986, and FIG. 1B illustrates a perspective view of the first, and second focusing electrodes shown in FIG. 1A.

Referring to FIGS. 1A and 1B, an electron gun 1 is comprised of a triode 2 for forming electron beams and a main focusing lens 3 for focusing the electron beams. The triode 2 is provided with cathodes 4 for emitting thermal electron beams, a control electrodes 5 for controlling the thermal electrons, and an accelerating electrode 6 for accelerating the thermal electrons. The main focusing lens 3 disposed next to the triode 2 comprises a focusing electrode 7 having a first focusing electrode 71 to which a low static voltage is applied a second focusing electrode 72 of to which a high dynamic voltage is applied synchronous to a deflection of the electron beams, and an anode 8 disposed next to the second focusing electrode 72 to which a positive voltage is applied. The first focusing electrode 71 has a face 713 fitted with flat electrodes 712 vertical to the face 713 on both sides of each of three electron beam pass-through holes 711, and the second focusing electrode 72 has a face 723 opposite to the first focusing electrode 71 fitted with one pair of flat electrodes 722 on an upper and a lower parts of three electron beam pass-through holes 721 toward the cathodes. Upon application of the voltages to the respective electrodes, the electron beams are controlled and accelerated by powers from the control electrode 5 and the accelerating electrode 6. Then, the electron beams pass through a dynamic quadrupole lens formed by a voltage difference between the low static voltage of the first focusing electrode 71 and the high voltage of the second focusing electrode 72. The dynamic quadrupole lens converges the electron beams in a horizontal direction because the first focusing electrode 71, a low voltage and involved in converging of electron beams, has the vertical flat electrodes 712 fitted in a horizontal direction of the face 713 thereof, and, thereafter, the beam diverges the electron beams in a vertical direction because the second focusing electrode 72, involved in diverging of electron beams, has the horizontal flat electrodes 722 fitted on upper part and lower part of the electron beam pass-through holes 721 in the face 723 thereof. Accordingly, the dynamic quadrupole lens elongates the electron beams in a vertical direction. The vertically elongated electron beams are then converged by the main focusing static lens formed by a voltage difference between the second focusing electrode 72 and the anode 8. Finally, the electron beams are accelerated toward the screen by the positive voltage and deflected by a non-uniform magnetic field formed by deflection yokes(not shown). Though the non-uniform magnetic field can correct mis-convergence, the non-uniform magnetic field elongates the electron beams in a horizontal direction, causing a haze coming from a thin image dispersion on upper and lower parts of an electron beam spot on the screen. However, as the electron beams are elongated in a vertical direction by the dynamic quadrupole lens, the electron beams are not elongated in the horizontal direction by the non-uniform magnetic field, but forms a good electron beam spot.

However, this background art electron gun has a problem in that the separately forming and welding of the horizontal flat electrodes 712 and the vertical flat electrodes 722 on the first, and second focusing electrodes 71 and 72 at faces thereof increases production time. Also, the horizontal flat electrodes 712 and the vertical flat electrodes 722 are susceptible to distortion by an external impact during transportation, storage and fabrication. Further, the electrodes 712 and 722 do not easily weld vertically on respective faces 713 and 723 of the first, and second focusing electrodes 71 and 72, thereby causing a problem that a quality of the electron gun cannot be maintained uniform.

FIG. 2A illustrates a cross section of an exemplary background art in-line type electron gun with another type of focusing electrode disclosed in Japanese Laid Open Patent Application (A) No. H2-72546 dated Mar. 12, 1990, and FIG. 2B illustrates a section across line I—I shown in FIG. 2A. Herein, parts that are identical to the previous background art of FIG. 1 are given the same numerals.

The focusing electrode 7 comprise a first focusing electrode 71 to which a low static voltage is applied and a second focusing electrode 72 to which a high dynamic voltage is applied synchronous to a deflection of the electron beams. The first focusing electrode 71 has a face 713 with a single horizontally elongated electron beam pass-through hole 711 formed therein and an inner guide electrode 73 with three electron beam pass-through holes 731 formed therein disposed at an inner side of the face 713, and the second focusing electrode 72 has a face 723 opposite to the first focusing electrode 71 and fitted with one pair of horizontal flat electrodes 722 toward the cathodes on upper and lower parts of three electron beam passthrough holes 721. Upon application of the dynamic voltage to the second focusing electrode 72, a dynamic quadrupole lens is formed between the face 713 of the first focusing electrode 71 with the single electron beam pass-through hole 711, the horizontal flat electrodes 722 and the inner guide electrode 73. The dynamic quadrupole lens diverges the electron beams in a vertical direction because the second focusing electrode 72, which diverges the electron beams, has the horizontal flat electrodes on upper and lower parts of the electron beam pass-through holes 721. In addition to this, by adjusting a fitted depth of the inner guide electrode 73 in the first focusing electrode 71, power of the dynamic quadrupole lens may be adjusted, which provides a versatile electron gun that can be used in color cathode ray tubes of multiple models. This eliminates cumbersome designs of the first and second focusing electrodes required for different power of the dynamic quadrupole lens for color cathode ray tubes of similar models.

However, this electron gun has a problem in that, when the inner guide electrode 73 is fitted deeper toward the cathodes 4 in the first focusing electrode 71, a center electron beam is involved in decreases of horizontal focusing power and vertical diverging power, resulting in horizontally elongating the center electron beam.

SUMMARY OF THE INVENTION

Accordingly, the present invention is directed a focusing electrode in an electron gun for a color cathode ray tube that substantially obviates one or more of the problems due to limitations and disadvantages of the related art.

An object of the present invention is to provide a focusing electrode in an electron gun for a color cathode ray tube, that reduces fabrication time and components and allows for a uniform quality to be obtained.

Another object of the present invention is to provide a focusing electrode in an electron gun for a color cathode ray tube, that prevents a horizontal elongation of the center electron beam.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the focusing electrode in an electron gun for a color cathode ray tube includes a first focusing electrode to which a low static voltage is applied and having a face with three vertically elongated electron beam pass-through holes of a key hole type, an inner guide electrode with three electron beam pass-through holes disposed at an inner side of the face, and a second focusing electrode to which a high dynamic voltage is applied and having correcting electrodes unitary with a face of the second focusing electrode opposite to the first focusing electrode formed in a cathode direction at upper and lower sides of each of the three electron beam pass-through holes, whereby facilitating changes of center and side powers of the dynamic quadrupole lenses formed between the electron beam pass-through holes/the inner guide electrode in the first focusing electrode and the correcting electrodes on application of the dynamic voltage to the second focusing electrode by changing lengths between the center correcting electrode and the side correcting electrodes according to a fitted depth of the inner guide electrode in the second focusing electrode.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1A:
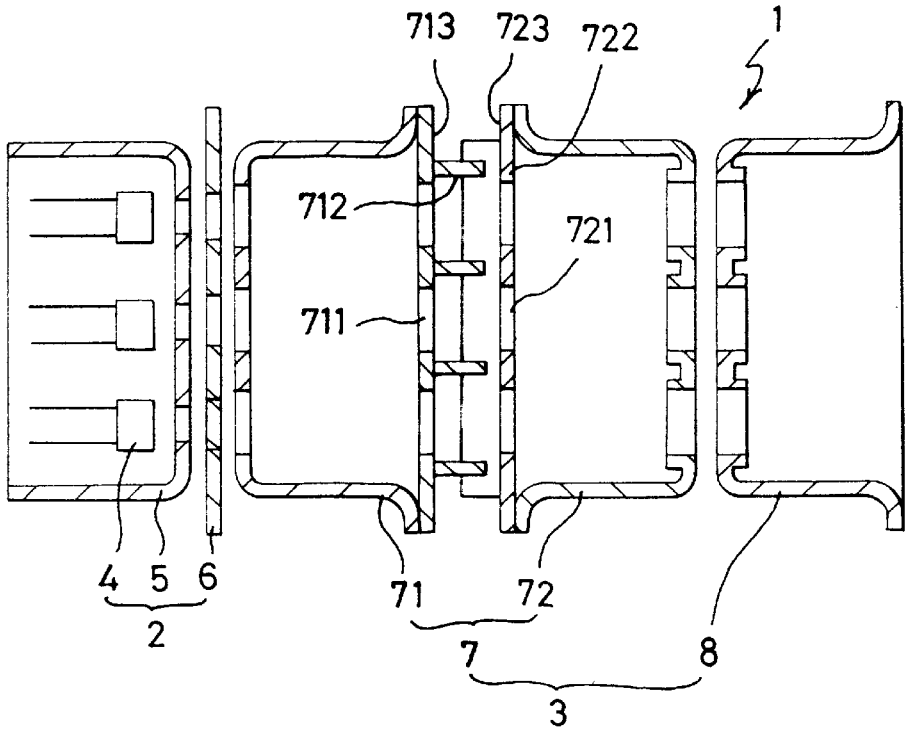
FIG. 1A Prior Art
FIG. 1A illustrates a cross section of an exemplary background art in-line type electron gun.
Figure 1B:
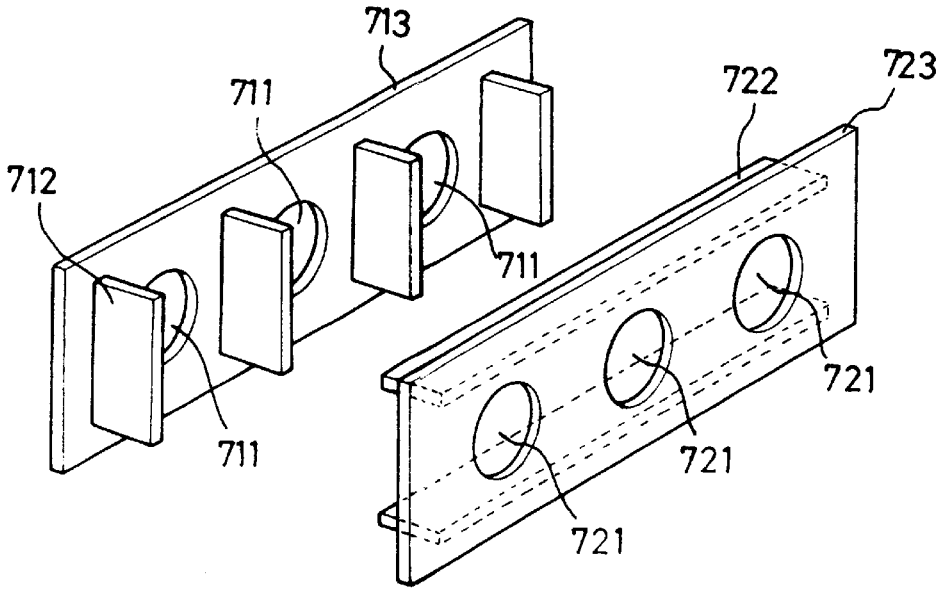
FIG. 1B Prior Art
FIG. 1B illustrates a perspective view of the first, and second focusing electrodes shown in FIG. 1A.
Figure 2A:
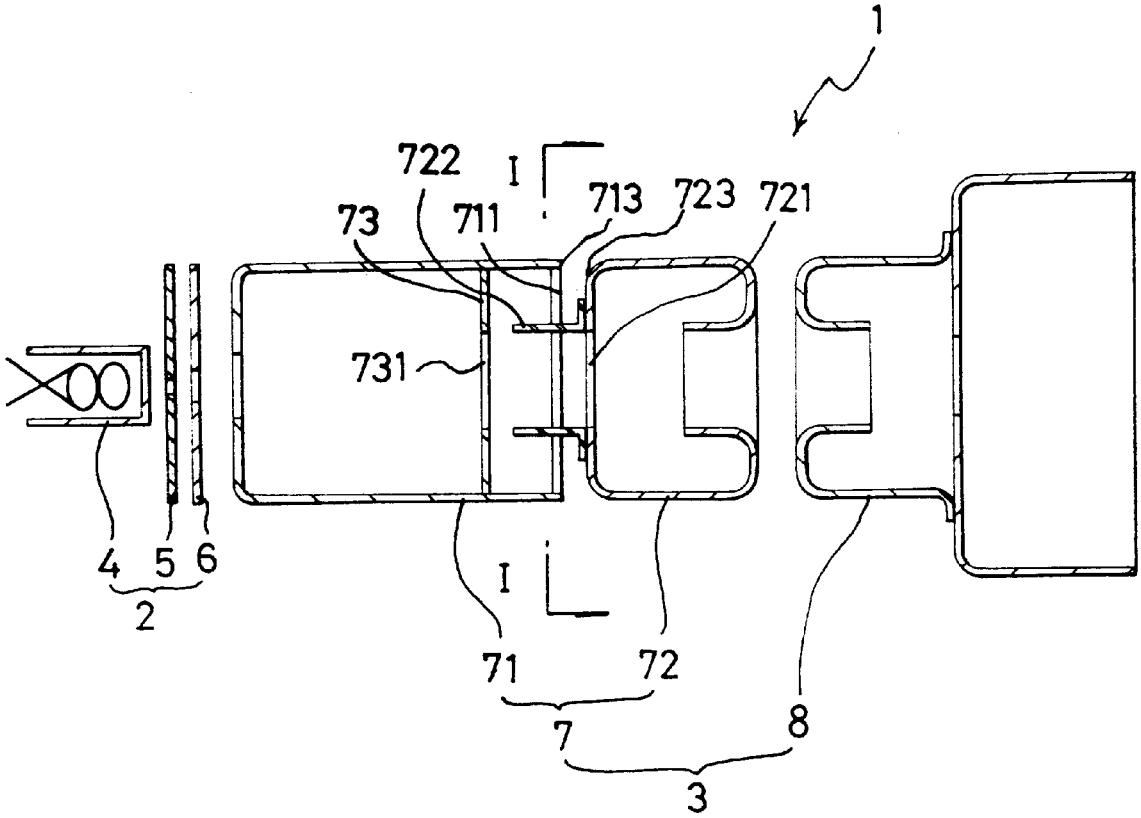
FIG. 2A Prior Art
FIG. 2A illustrates a cross section of an exemplary background art in-line type electron gun with another type of focusing electrode.
Figure 2B:
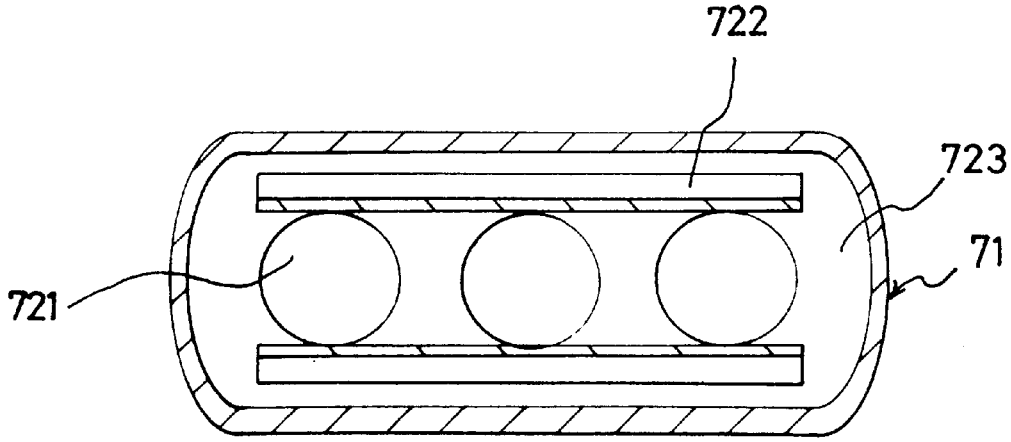
FIG. 2B Prior Art
FIG. 2B illustrates a section across line I—I shown in FIG. 2A.

Reference will now be made in detail to the preferred embodiments of the present invention, examples of which are illustrated in the accompanying drawings.

One feature of the focusing electrode in an electron gun for a color cathode ray tube of the embodiments of the present invention is that burring parts or horizontal flat electrodes are formed of the same material as the with second focusing electrode on a face of the second focusing electrode around of electron beam pass-through holes at the same time with formation of the electron beam passthrough holes.

Another feature of the focusing electrode in an electron gun for a color cathode ray tube of the embodiments of the present invention is that a center electron beam pass-through hole in an inner guide electrode is vertically elongated for preventing the center electron beam from being elongated horizontally.

FIGS. 3A, 3B, 3C and 3D illustrate perspective views of focusing electrodes in an electron gun for a color cathode ray tube in accordance with first, second, third and fourth preferred embodiments of the present invention, with partial cut-away views, wherein the same reference numerals are given to identical parts of the background arts first and second focusing electrodes.

Figure 3A:
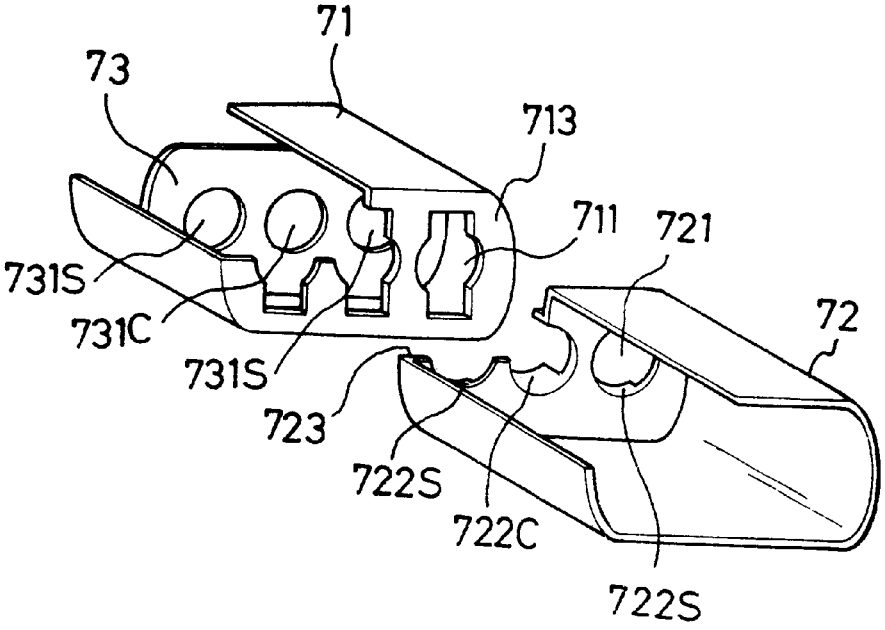
FIGS. 3A, 3B, 3C and 3D illustrate perspective views of focusing electrodes in an electron gun for a color cathode ray tube in accordance with first, second, third and fourth preferred embodiments of the present invention, with partial cut-away views.
Figure 3B:
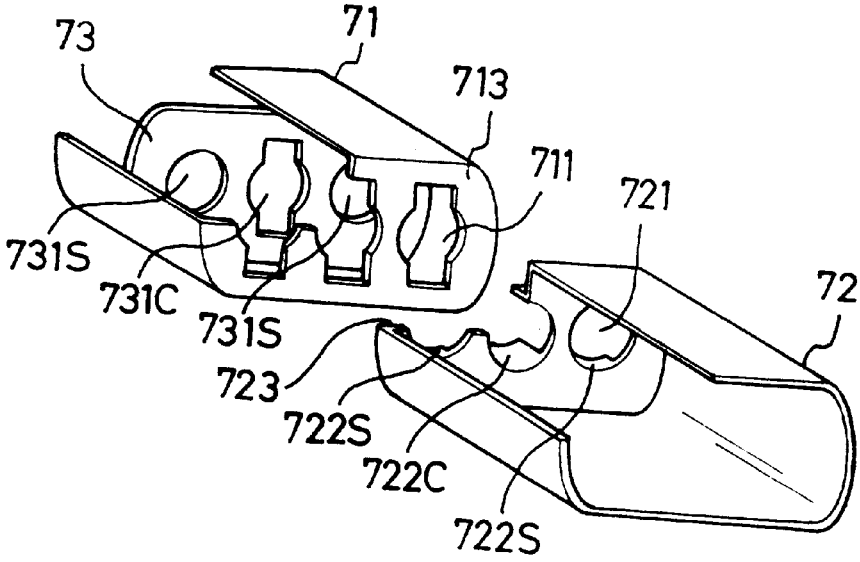
Figure 3C:
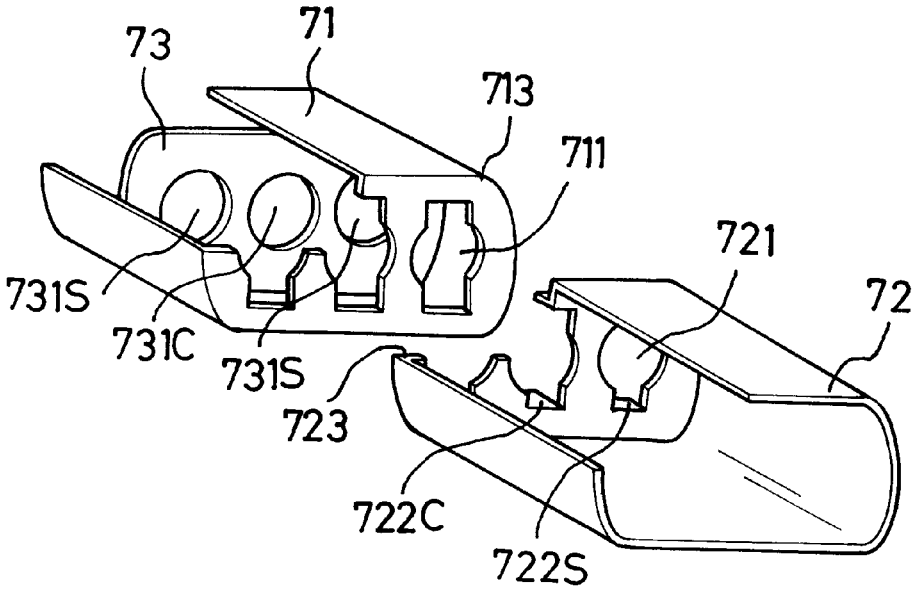
Figure 3D:
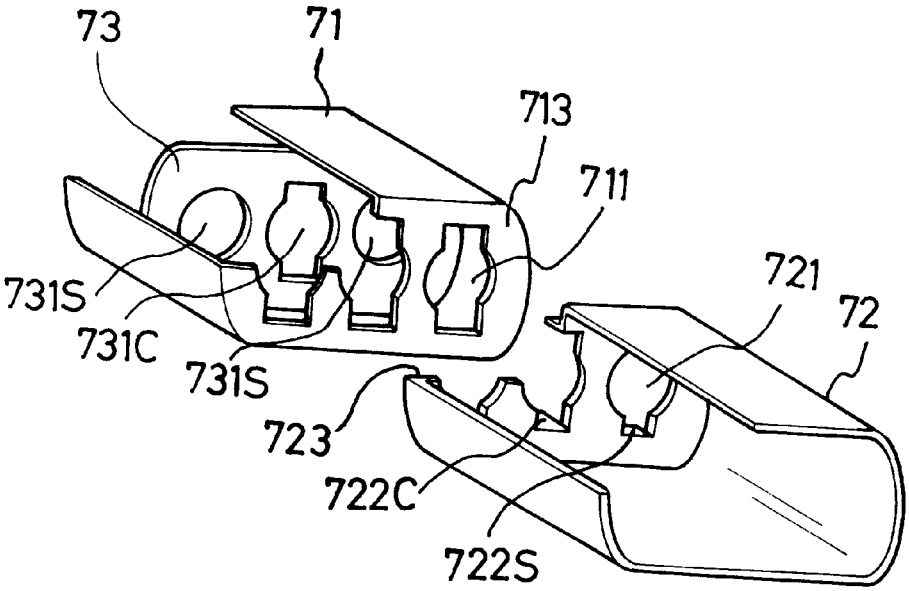

The focusing electrode 7 in an electron gun for a color cathode ray tube of the embodiments of the present invention includes a first focusing electrode to which 71 a low static voltage is applied. The first focusing electrode 71 has a face 713 with three vertically elongated electron beam pass-through holes 711 and an inner guide electrode 73 with three electron beam pass-through holes 731C and 731S fitted at an inner side of the face 713 the focusing electrode 7 also includes a second focusing electrode 72 to which a high dynamic voltage is applied synchronous to a deflection of the electron beams. The second focusing electrode 72 has correcting electrodes 722C and 722S formed on a face 723, opposite to the first focusing electrode 71, and in a direction of the cathodes on upper and lower sides of each of the three electron beam pass-through holes 721, this allows lengths of the center correcting electrode 722C and the side correcting electrodes 722S are varied with the fitted depth of the inner guide electrode in the second focusing electrode 72, for varying center and side powers of the dynamic quadrupole lens formed between the electron beam pass-through holes 711/the inner guide electrode 73 in the first focusing electrode 71 and the correcting electrodes 722C and 722S. The electron bean passthrough holes 711 in the first focusing electrode 71 may be, for example, formed in a key hole form. And, as shown in FIGS. 3A and 3B, the correcting electrodes 722C and 722S may be burring parts of the face 723 of the second focusing electrode 72 formed at the same time with the circular electron beam pass-through holes 721. The burring parts 722C and 722S are formed such that the center burring part 722C has a length longer than the side burring parts 722S, for preventing the electron beams from being elongated horizontally even if the fitted depth of the inner guide electrode 73 is moved deeper toward the cathodes by strengthening up and down direction diverging powers of the electron beams by means of the dynamic quadrupole lens formed by voltage differences of the burring parts 722C and 722S from the first and second focusing electrodes 71 and 72. As shown in FIGS. 3C and 3D, the correcting electrodes 722C and 722S may be horizontal flat electrodes formed with partial bents of the face 722 of the second focusing electrode 72 at the same time with formation of the vertically elongated key hole electron beam pass-through holes 721. The horizontal flat electrodes 722C and 722S also have a length of the center horizontal flat electrode 722C formed longer than the side horizontal flat electrodes 722S, preventing a horizontal elongation of the electron beams as the fitted depth of the inner guide electrode 73 are varied. In the meantime, as shown in FIGS. 3A and 3C, the three electron beam pass-through holes 731C and 731S in the inner guide electrodes 73 may be circular. However, if a horizontal elongation of the center electron beam has not been resolved satisfactorily, the center electron beam pass-through hole 731C is formed to be a vertically elongated key hole, as shown in FIGS. 3B and 3D. This causes the dynamic quadrupole lens strengthen its horizontal direction focusing power and weaken its vertical direction focusing power, thereby allowing the electron beams to form a good circular electron beam spot on the screen.

Without a great change in design, the focusing electrode in an electron gun of the present invention can be applicable to models of color cathode ray tubes within a certain range.

The formation of the burring parts or the horizontal flat electrodes at the same time with the formation of the electron beam pass-through holes facilitates a reduction of required components and an improvement of productivity.

The omission of separate formation and welding of the vertical, and horizontal flat electrodes as the background arts prevents a degradation of a quality of the electron gun coming from distortion or fabrication defects of the vertical, and horizontal flat electrodes, from the source.

It will be apparent to those skilled in the art that various modifications and variations can be made in the focusing electrode in an electron gun for a color cathode ray tube of the present invention without departing from the spirit or scope of the invention. Thus, it is intended that the present invention cover the modifications and variations of this invention provided they come within the scope of the appended claims and their equivalents.

What is claimed is:

1. A focusing electrode in an electron gun for a color cathode ray tube, comprising:

a first focusing electrode to which a low static voltage is applied, the first focusing electrode having a face with three vertically elongated electron beam pass-through holes of a key hole type and an inner guide electrode with three electron beam pass-through holes disposed at an inner side of the face; and, a second focusing electrode to which a high dynamic voltage is applied, the second focusing electrode having correcting electrode unitary with a face of the second focusing electrode opposite to the first focusing electrode formed in a cathode direction at upper and lower sides of each of the three electron beam pass-through holes of the face of the second focusing electrode, whereby facilitating changes of center and side powers of the dynamic quadruple lenses formed between the electron beam pass-through holes of the inner guide electrode in the first focusing electrode and the correcting electrodes on application of the dynamic voltage to the second focusing electrode by changing lengths between the center correcting electrode and the side correcting electrodes according to a fitted depth of the inner guide electrode in the second focusing electrode.

2. The focusing electrode as claimed in claim 1, wherein the center correcting electrode has a length longer than the side correcting electrodes.

3. The focusing electrode as claimed in claim 2, wherein the electron beam pass-through holes in the second focusing electrode are circular, and the correcting electrodes are burring parts.

4. The focusing electrode as claimed in claim 2, wherein the electron beam pass-through holes in the second focusing electrode are vertically elongated.

5. The focusing electrode as claimed in claim 4, wherein each of the electron beam passthrough holes in the second focusing electrode has a form of a key hole, and each of the correcting electrodes is a horizontal flat electrode formed with a partial bent of the face of the second focusing electrode.

6. The focusing electrode as claimed in claim 3, wherein the electron beam pass-through holes in the inner guide electrode are circular.

7. The focusing electrode as claimed in claim 3, wherein the electron beam pass-through holes in the inner guide electrode are vertically elongated in a center and circular in sides.

8. The focusing electrode as claimed in claim 7, wherein the electron beam pass-through hole in the center has a key hole form.

9. The focusing electrode as claimed in claim 5, wherein the electron beam pass-through holes in the inner guide electrode are circular.

10. The focusing electrode as claimed in claim 5, wherein the electron beam pass-through holes in the inner guide electrode are vertically elongated in a center and circular in sides.

11. A focusing electrode in an electron gun for a color cathode ray tube, comprising:

a first focusing electrode, to which a low static voltage is applied, having a face ("first face") with three electron beam pass-through holes; and a second focusing electrode, to which a high dynamic voltage is applied, having a face ("second face") with three electron beam pass-through holes and being positioned opposite said first face, said second face having correcting electrodes, and said correcting electrodes formed at upper and lower sides of each of said three electron beam pass-through holes of said second face.

12. The focusing electrode of claim 11, wherein a center correcting electrode has a longer length than side correcting electrodes.

13. The focusing electrode of claim 11, wherein said electron beam pass-through holes of said first face are vertically elongated.

14. The focusing electrode of claim 11, wherein said electron beam pass-through holes of said second face are circular.

15. The focusing electrode of claim 14, wherein said correcting electrodes are burring parts.

16. The focusing electrode of claim 11, wherein said electron beam pass-through holes of said second face are vertically elongated.

17. The focusing electrode of claim 16, wherein said correcting electrodes are formed with partial bents of said second face.

18. The focusing electrode of claim 11, wherein said first focusing electrode further comprises an inner guide electrode also with three electron beam pass-through holes disposed at an inner side of said first face.

19. The focusing electrode of claim 18, wherein said electron beam pass-through holes of said inner guide electrode is are circular.

20. The focusing electrode of claim 18, wherein a center electron beam pass-through hole of said inner guide electrode is vertically elongated.

21. The focusing electrode of claim 11, wherein said correcting electrodes are unitary with said second face.

* * * * *